US010112094B1

(12) United States Patent
Odorisio et al.

(10) Patent No.: US 10,112,094 B1
(45) Date of Patent: Oct. 30, 2018

(54) SOCCER TRAINING ARENA

(71) Applicants: Anthony D. Odorisio, Mt. Pleasant, IA (US); Dante D. Odorisio, Omaha, NE (US)

(72) Inventors: Anthony D. Odorisio, Mt. Pleasant, IA (US); Dante D. Odorisio, Omaha, NE (US)

( * ) Notice: Subject to any disclaimer, the term of this patent is extended or adjusted under 35 U.S.C. 154(b) by 17 days.

(21) Appl. No.: 15/493,668

(22) Filed: Apr. 21, 2017

(51) Int. Cl.

| | |
|---|---|
| ***A63B 69/00*** | (2006.01) |
| *A63B 67/00* | (2006.01) |
| *A63B 47/00* | (2006.01) |
| *A63B 63/00* | (2006.01) |
| *A63B 24/00* | (2006.01) |

(52) U.S. Cl.
CPC ..... *A63B 69/002* (2013.01); *A63B 24/0075* (2013.01); *A63B 47/002* (2013.01); *A63B 63/00* (2013.01); *A63B 67/00* (2013.01); *A63B 69/00* (2013.01); *A63B 69/0097* (2013.01)

(58) Field of Classification Search
CPC ..... A63B 69/002; A63B 63/00; A63B 69/00; A63B 69/0097; A63B 47/002; A63B 69/0053; A63B 71/0622; A63B 67/002; A63B 24/0021; A63B 24/0075; A63C 67/00; A63C 19/00
USPC ..... 473/422, 432, 435, 446, 416, 471, 478, 473/476, 434
See application file for complete search history.

(56) References Cited

U.S. PATENT DOCUMENTS 4,083,561 A * 4/1978 Daffer, Jr. ..... A63B 63/004 473/432
4,203,594 A * 5/1980 Cagle ..... A63B 67/00 472/94
4,258,924 A * 3/1981 Ketchum ..... A63B 69/0097 473/435
4,286,786 A * 9/1981 Papadopoulos ..... A63B 63/004 473/432
4,645,210 A * 2/1987 Patsy ..... A63B 63/06 473/446
5,312,109 A * 5/1994 Cagle ..... A63C 19/06 473/446
5,524,900 A * 6/1996 Allen ..... A63B 69/0097 273/396
5,558,338 A * 9/1996 Taub ..... A63B 69/0071 473/416
5,599,025 A * 2/1997 Pobee-Mensah .... A63B 67/002 473/471

(Continued)

*Primary Examiner* — Mitra Aryanpour
(74) *Attorney, Agent, or Firm* — Dennis L. Thomte; Thomte Patent Law Office LLC

(57) ABSTRACT

A soccer training facility or arena of this invention includes an upstanding wall system having an upper end and a lower end. The wall system has at least one and preferably a plurality of horizontally spaced-apart rectangular target openings formed therein at the lower end thereof. A training target is positioned in each of the target openings and which is movable between a normally inner position to an outer position. The training target is moved from its inner position to its outer position upon the training target being struck by a soccer ball. The training targets are sequentially illuminated by a controller for a predetermined length of time. The number of illuminated training targets being struck by a soccer ball within a preselected period of time is recorded.

7 Claims, 11 Drawing Sheets

(56) References Cited

U.S. PATENT DOCUMENTS

| | | | | |
|---|---|---|---|---|
| 5,738,588 | A * | 4/1998 | Esser | A63C 19/00 472/92 |
| D652,462 | S * | 1/2012 | Sun | D21/706 |
| 8,480,517 | B2 * | 7/2013 | Guttler | A63B 47/002 473/422 |
| 8,506,370 | B2 * | 8/2013 | Homsi | A63B 24/0021 463/15 |
| 9,266,002 | B2 * | 2/2016 | Dunser | A63B 63/00 473/446 |
| 9,273,197 | B2 | 3/2016 | Miyazaki | |
| 9,278,270 | B2 | 3/2016 | Adema | |
| 9,283,459 | B2 | 3/2016 | Adema | |
| 2002/0022540 | A1 * | 2/2002 | Slomski | A63B 69/002 473/478 |
| 2002/0042312 | A1 * | 4/2002 | Decloux | A63B 63/004 473/476 |
| 2004/0132558 | A1 * | 7/2004 | Rothman | A63B 69/002 473/434 |
| 2004/0266563 | A1 * | 12/2004 | Young | A63B 69/002 473/446 |
| 2006/0089213 | A1 * | 4/2006 | Snyder | A63B 24/0021 473/435 |
| 2009/0069123 | A1 * | 3/2009 | Nugent | A63B 24/0021 473/422 |
| 2009/0069125 | A1 * | 3/2009 | Porter | A63B 69/0097 473/435 |
| 2016/0317891 | A1 | 11/2016 | Adema | |

* cited by examiner

SOCCER TRAINING ARENA

BACKGROUND OF THE INVENTION

Field of the Invention

This invention relates to a soccer training arena which requires a soccer player to kick or pass a soccer ball onto horizontally spaced-apart training targets within a recorded time with the training targets being located in the lower end of an upstanding wall which at least partially encloses a playing area. Even more particularly, this invention includes means for selectively illuminating the training targets and for recording the hits of the soccer ball onto the training targets.

Description of the Related Art

Many types of training facilities or arenas have been provided for improving the passing, kicking, receiving and dribbling abilities of soccer players. As used herein, the word "soccer" is meant to include the International game called football. Typical of the prior art attempts to improve the skills of a soccer player or to provide a game for soccer players are U.S. Pat. Nos. 9,273,197; 9,278,270; and 9,283,459. U. S. Publication No. 2016/0317891 A1 also discloses a soccer training related game.

Although the prior art may provide soccer training methods or games, the prior art lacks certain important features which may be utilized in the training of soccer players.

First, the prior art does not provide selective illuminated targets which are horizontally spaced-apart in the lower end of an upstanding wall which at least partially encloses a training floor or area. Second, the prior art does not provide any means for selectively illuminating the training targets in a pre-selected sequence to require the soccer player to adjust to whatever target or targets are illuminated. Third, the prior art does not disclose spring-loaded training targets. Fourth, the prior art does not disclose spring-loaded training targets may be inclined somewhat to cause a soccer ball, which strikes the target, to cause the soccer ball to be rebounded to the player in an upwardly rising manner. Fifth, the prior art does not provide inclined ramps on the floor of the facility or arena adjacent the lower inner side of the training targets which causes a struck soccer ball which comes into contact with the ramp to be moved upwardly towards the training target.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A soccer training facility or arena is provided to enable a soccer player to perfect his/her soccer passing, kicking, receiving and dribbling ability. The facility includes an upstanding wall system which extends substantially around a training space having a floor or a play surface. The upstanding wall system includes an upper end, a lower end, an inner side and an outer side. The wall system has a plurality of horizontally spaced-apart and generally rectangular training target openings formed therein which are located at the lower end of the wall system. A generally rectangular training target is positioned in each of the training target openings with each of the training targets having an inner side, an outer side, a lower end, an upper end, a right end and a left end. Each of the training targets are movable with respect to the training target openings and the wall system between an outer position and an inner position. A plurality of spring-loaded mounts which are associated with each of the training targets and which are configured to yieldably maintain the associated training target in its outer position. Each of the training targets is movable from its outer position to its inner position upon the inner side thereof being struck by a kicked soccer ball.

A light means is associated with each of the training targets for illuminating the associated training target. Means is provided for sequentially activating the light means of each of the training targets to indicate to the player which training target should be addressed. Means is also provided for recording the number of training targets struck by a soccer ball in a predetermined length of time.

In one embodiment, the upstanding wall system is generally oval-shaped but may take other shapes. In the preferred embodiment, the upstanding wall system extends completely around the training space except for a door or the like provided in the wall system.

In the preferred embodiment, a ramp is formed in the floor of the training space which extends downwardly and away from the lower end of at least one of the training targets.

In the preferred embodiment, the light means associated with each of the training targets is mounted on the upper end, the right end and the left end of the training target.

In the preferred embodiment, the recording of the training targets being struck by a soccer ball will only occur while the training target is illuminated. Also in the preferred embodiment, the training targets will only stay illuminated for a predetermined length of time. Also in the preferred embodiment, at least one of the training targets is inclined so as to extend upwardly and outwardly from its lower end to its upper end.

It is therefore a principal object of the invention to provide an improved soccer training facility or arena.

A further object of the invention is to provide a soccer training facility or arena which includes a wall system which extends at least partially around a training space with the wall system having a plurality of horizontally spaced-apart training targets positioned therein.

It is also an object of the invention to provide a soccer training facility or arena which includes horizontally spaced-apart training targets which are illuminated for a short period of time in a sequential manner.

It is also an object of the invention to provide a soccer training facility or arena which includes illuminated training targets.

A further object of the invention is to provide a soccer training facility or arena which requires a soccer player to kick or pass towards a series of training targets as determined by a controller.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Figure 1:
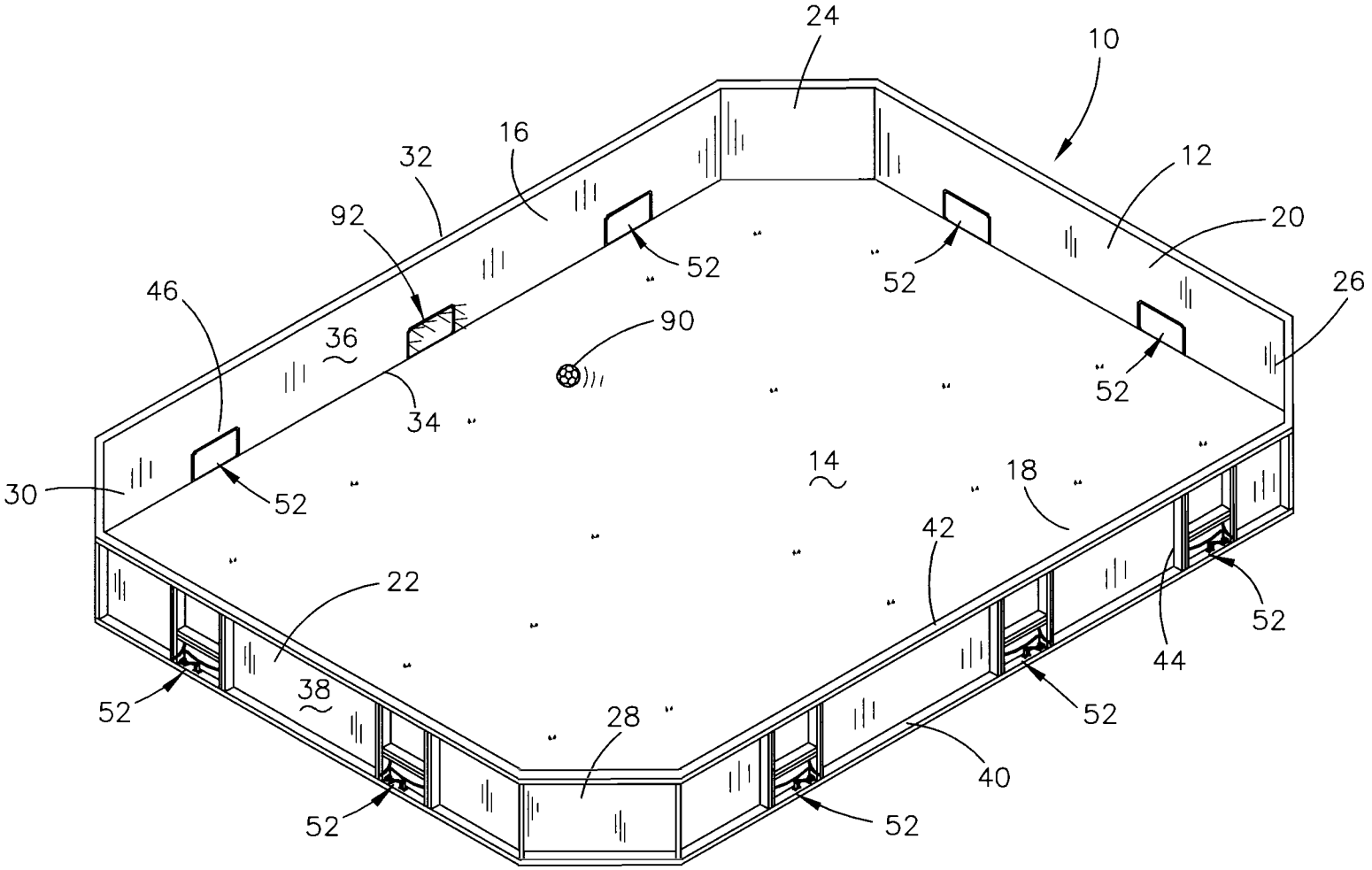
FIG. 1 is a perspective view of one configuration of the soccer training facility or arena of this invention.

The numeral 10 refers generally to the soccer training facility or arena of this invention. Although the soccer training facility 10 will be described as having the shape or configuration as seen in FIG. 1, the soccer training facility could have the shape or configuration such as shown in Fig. A-Fig. G and which will be designated with the reference numerals 10A-10G respectively. For purposes of description, only the soccer training facility 10 will be described in detail.

Facility 10 includes an upstanding wall 12 which preferably extends completely around the field or floor 14 but which could only partially extend around the floor 14. Wall 12 may be constructed of wood, metal, masonry, plastic, fiberglass, foam or any combination thereof. As seen in FIG. 1, the shape or configuration of wall 12 is generally oval. Wall 12 will be described as having a first side wall section 16, a second side wall section 18, a first end wall section 20, a second end wall section 22, and corner wall sections 24, 26, 28 and 30.

Wall 12 will be described as having an upper end 32, a lower end 34, an inner side 36 and an outer side 38. Wall 12 includes a 2"×4" or a 2"×6" base plate 40 at its lower end and a 2"×4" or a 2"×6" top plate 42 at its upper end. The base plate 40 and the top plate 42 may be constructed of wood or other suitable material. The base plate 40 of wall 12 rests upon the floor 14.

A plurality of vertically disposed 2"×6" studs 44 are secured to the plates 40 and 42 and extend therebetween in a horizontally spaced-apart manner. Plates 40 and 42 and the studs 44 are constructed of wood or other suitable material. Wall 12 includes a panel or wall member 46 which extends between the plates 40 and 42 at the inner sides thereof.

Figure 2:
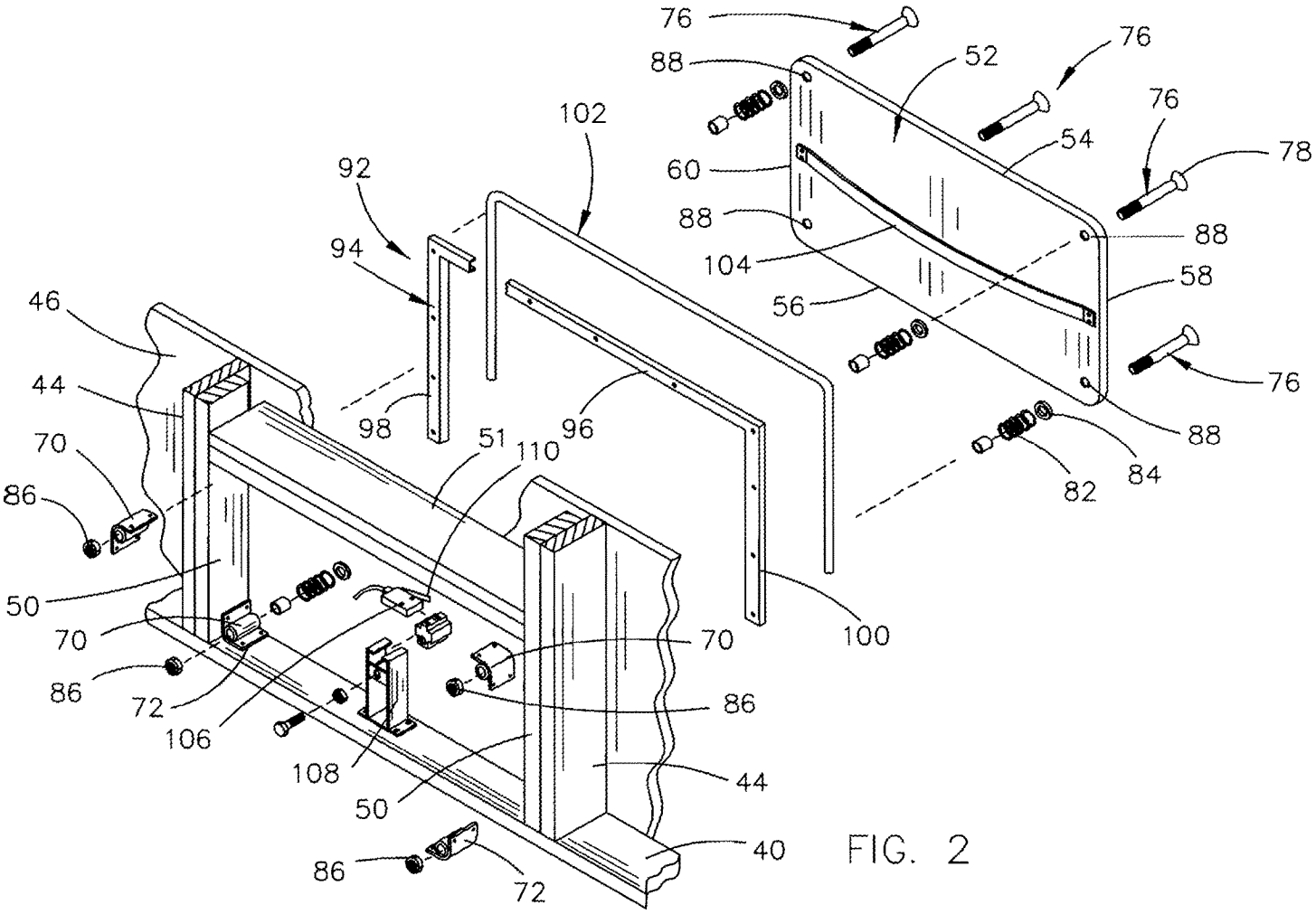
FIG. 2 is an exploded perspective view of one of the training targets of this invention together with its associated components.
Figure 3:
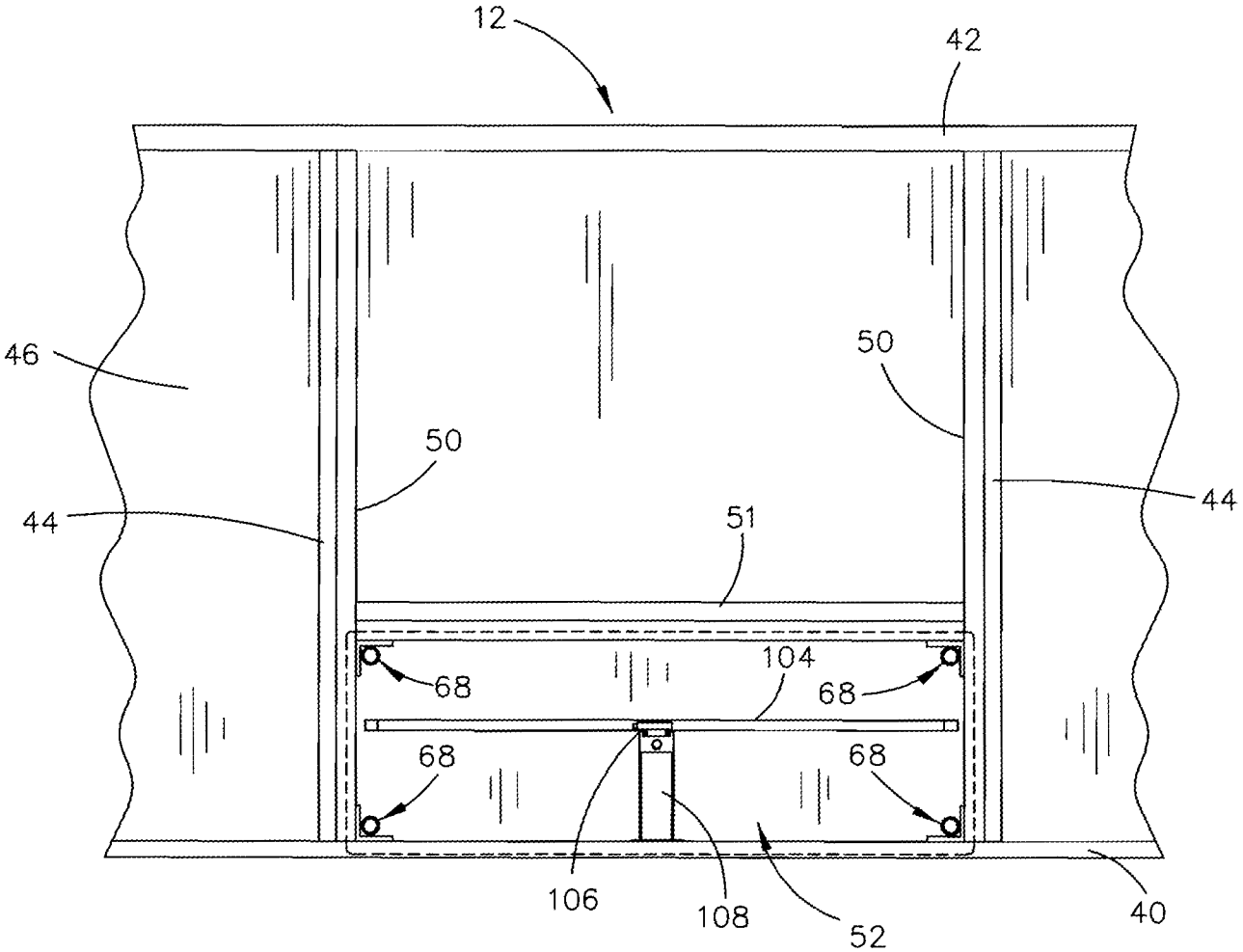
FIG. 3 is a partial outer elevational view of one of the training targets mounted in the wall of the facility or arena of this invention.
Figure 4:
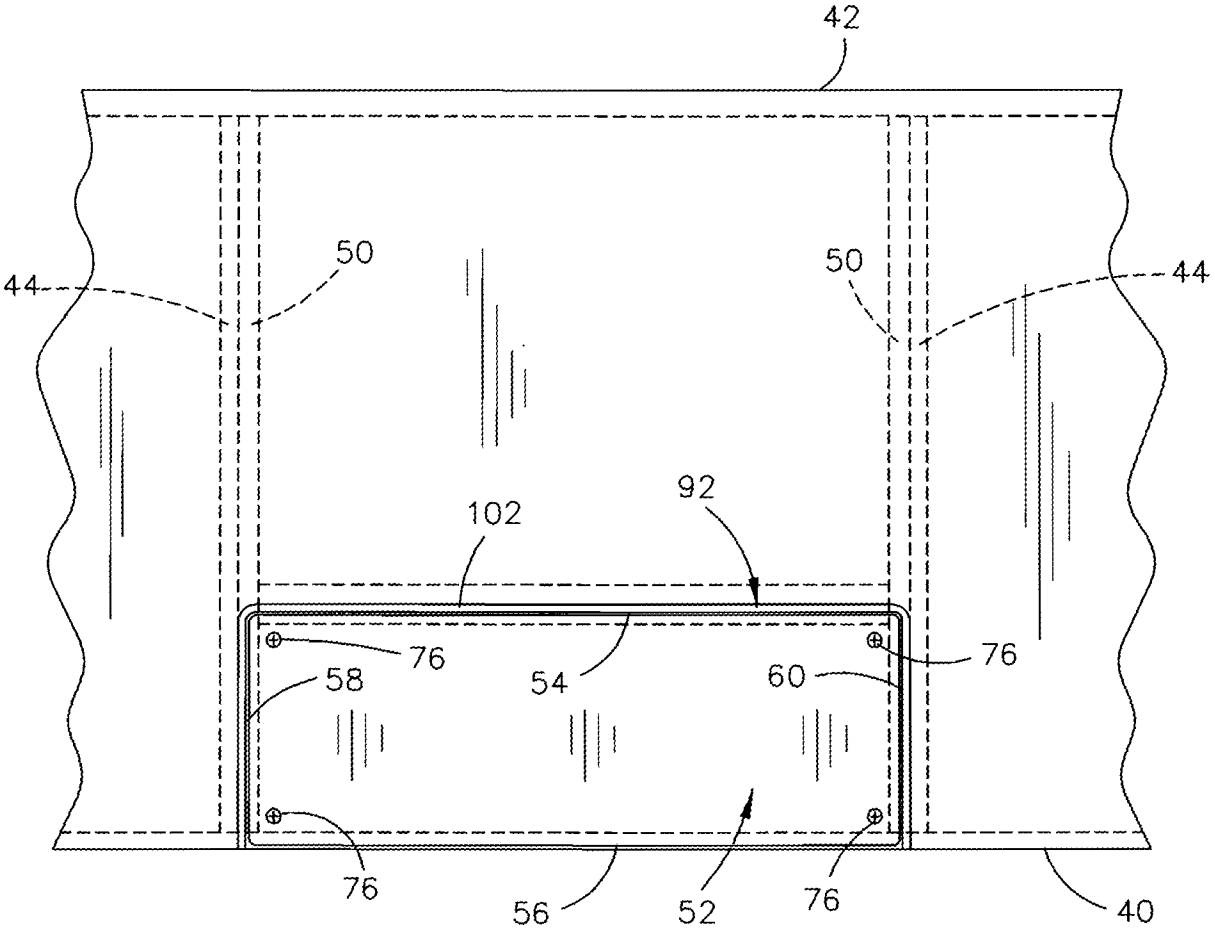
FIG. 4 is a partial inner elevational view of one of the training targets mounted in the wall of the facility or arena of this invention.

A plurality of horizontally spaced-apart training target openings 48 are formed in the wall member 46 at the lower end thereof and which preferably have a generally rectangular shape. At each training target opening 48, a pair of vertically disposed 2"×4" support members 50 is secured to adjacent 2"×6" studs 44 as seen in FIG. 2. A horizontally disposed 2"×6" support member 51 is secured to the support members 50 and extends therebetween as also seen in FIG. 2. Support member 51 is positioned at the upper end of the training target opening 48.

Figure 5:
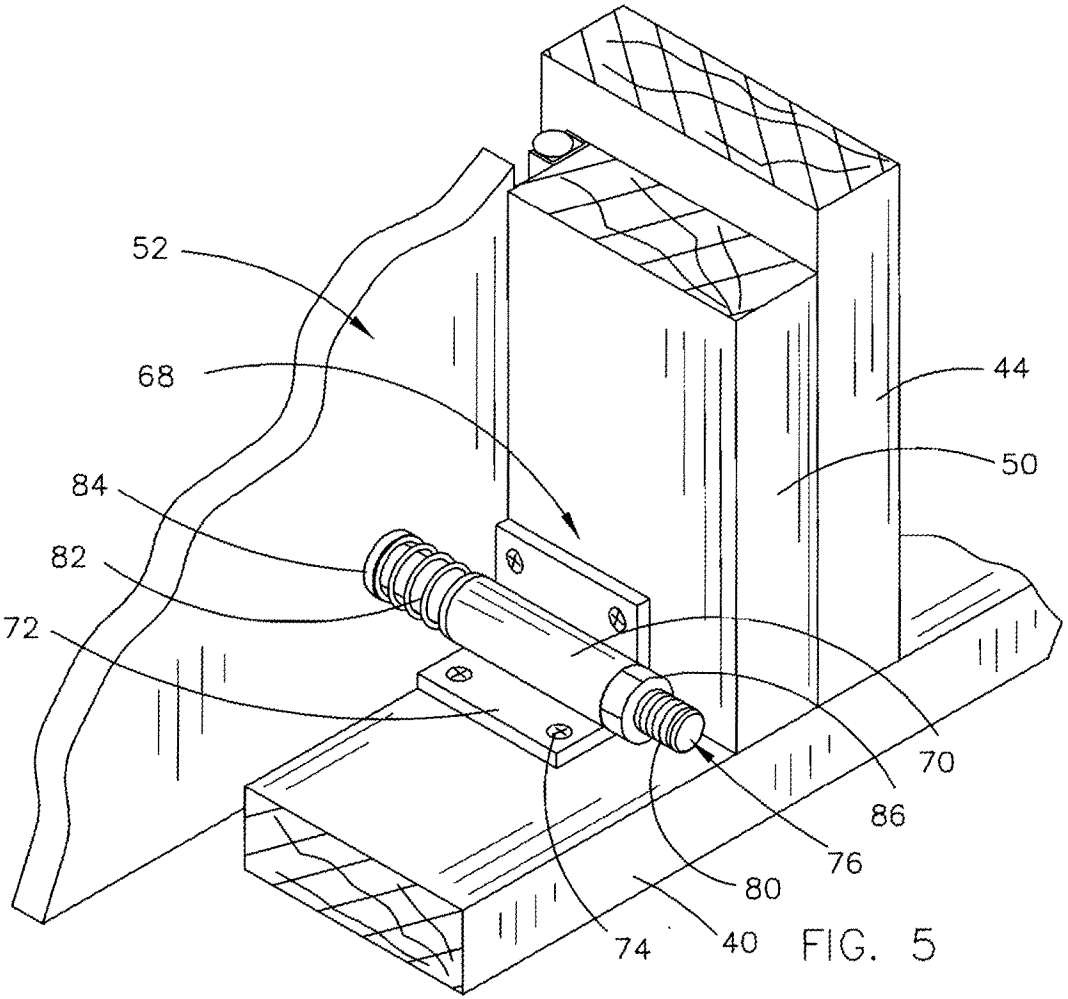
FIG. 5 is a partial perspective view of one of the four of the spring-loaded mounts which position the training target in an opening formed in the wall of the facility or arena of this invention.
Figure 6:
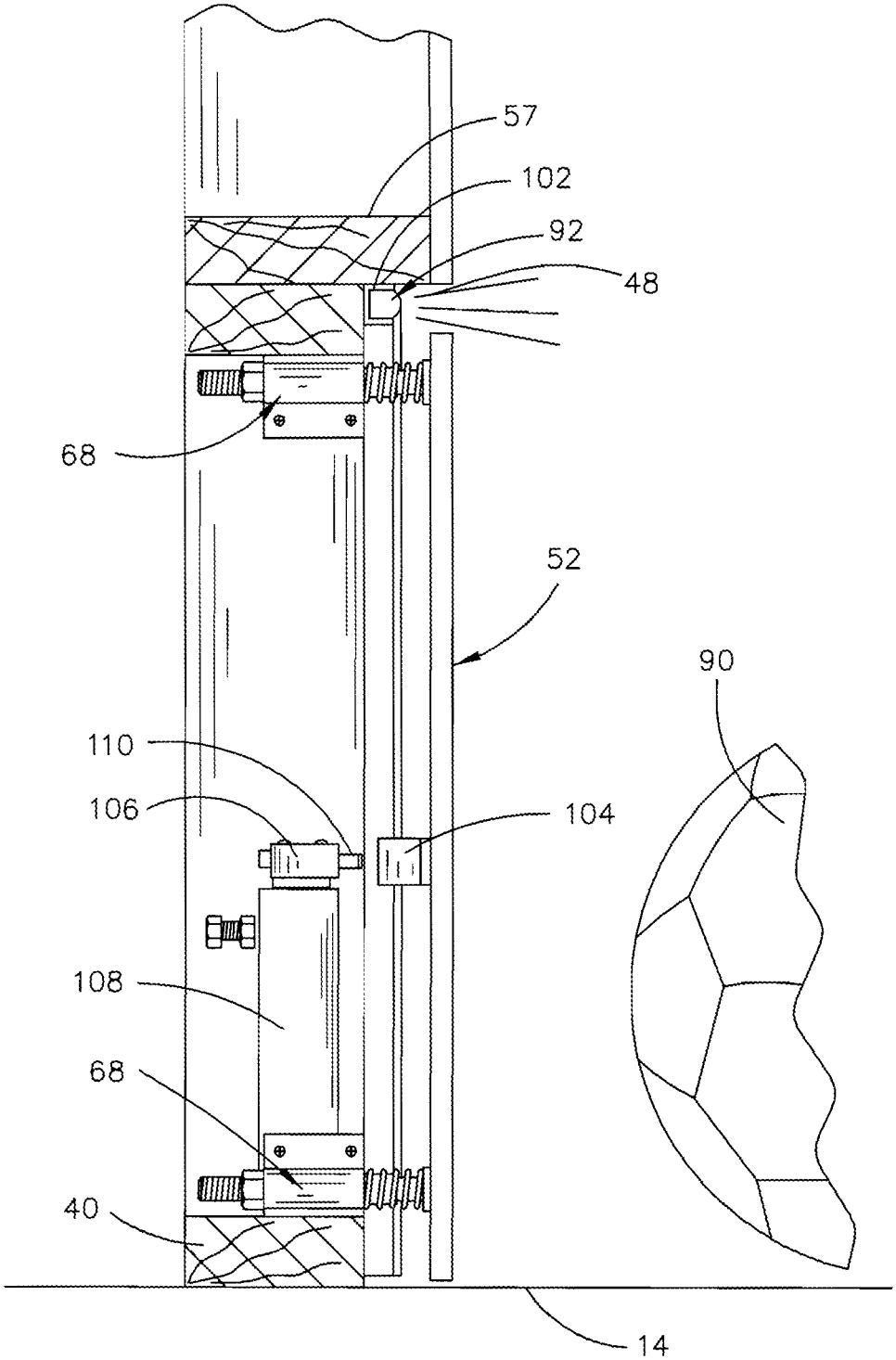
FIG. 6 is a partial sectional view of the wall of the facility or arena of this invention which has a training target mounted in an opening formed in the wall thereof.
Figure 6A:
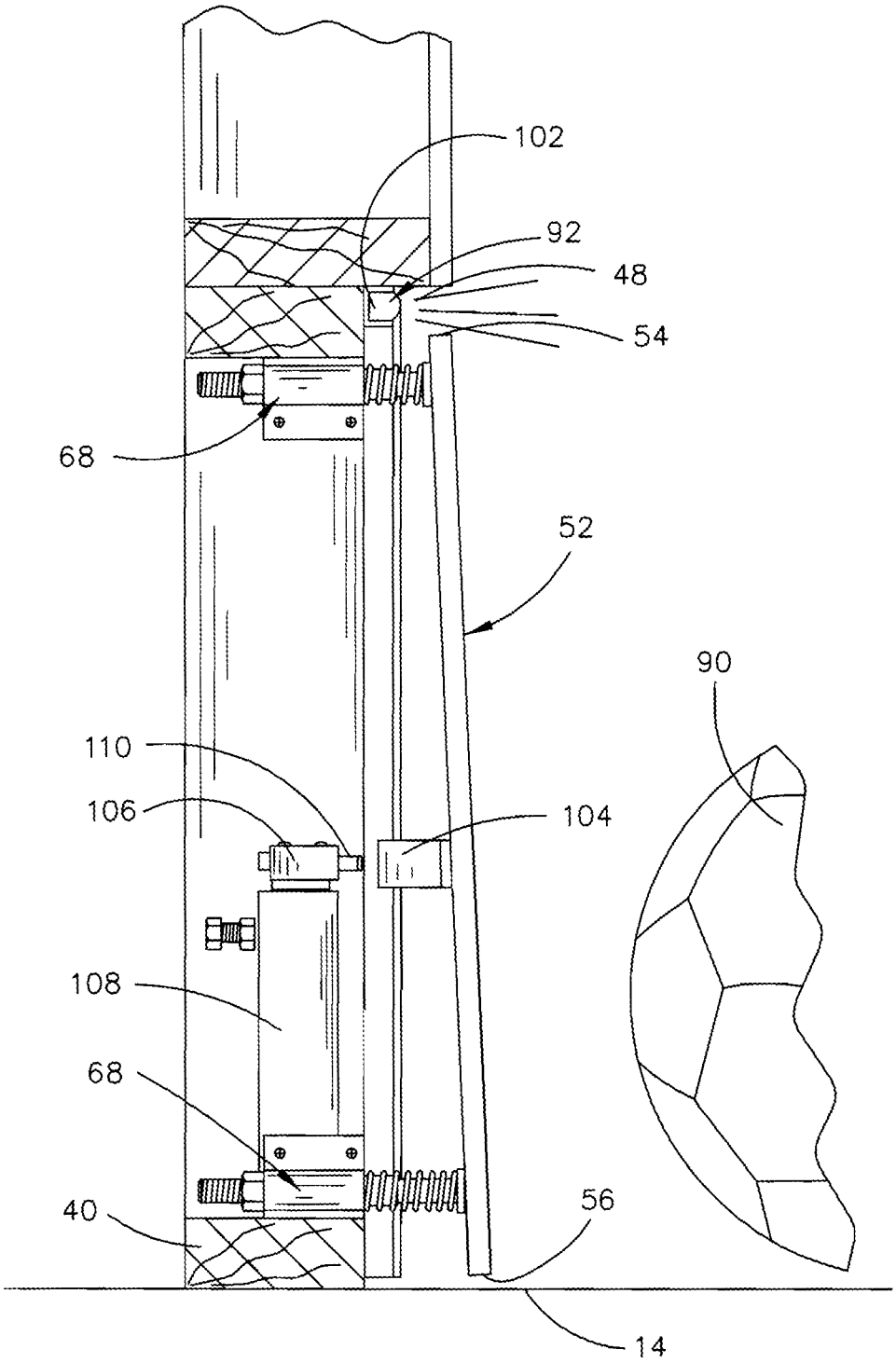
FIG. 6A is a partial sectional view similar to FIG. 6 except that the training target is somewhat inclined upwardly and outwardly from its lower end to its upper end.

A rectangular training target 52 is movably positioned in each of the training target openings 48 and will be described as having an upper end 54, a lower end 56, a first end 58, a second end 60, an inner side 62 and an outer side 64. As seen in FIG. 2, an opening 66 is formed in each of the corners of the target 52. The targets 52 are mounted in the openings 48 by four mounts 68, each of which are positioned at one of the corners of the target 52. Each of the mounts 68 include a hollow body member 70 which has a mounting bracket 72 attached thereto. The mount 68 shown in FIG. 5 is attached to the base plate 40 and a support member 50 by screws 74 extending through mounting bracket 72. Each of the mounts 68 includes a spring-loaded support rod 76 having an enlarged head 78 at its inner end and a threaded portion 80 at its outer end. Rod 76 extends through one of the openings 66 in target 52 and into body portion 70. A spring 82 embraces rod 76 between body member 70 and the outer side of target 52 as seen in FIG. 5. One end of spring 82 engages body member 70 with the other end thereof engaging a washer 84 which abuts the outer side of target 52. A nut 86 is threadably mounted on the threaded portion 80 of rod 76 to maintain rod 76 in body member 70 and to adjust the tension in the spring 82. The four mounts 68 yieldably movably mount the target 52 in the opening 48. As seen in FIG. 6, the mounts 68 position the target 52 in a vertically disposed position. However, one or more of the targets 52 may be mounted in their respective opening 48 whereby the target 52 is inclined as seen in FIG. 6A so that a soccer ball 90 striking the target 52 will be rebounded from the target 52 in an upwardly fashion away from the target 52. The springs 82 of the mounts 68 permit the target 52 to be yieldably held in a practice position while being able to move somewhat rearwardly upon being struck by a soccer ball 90 as will be explained hereinafter.

Each of the targets 52 have openings 88 formed therein at the corners thereof as seen in FIG. 2. The support rods 76 extend through the openings 88 from the inner side of the target 52. The enlarged heads 78 of the rods 76 then limit the inner movement of the rods 76 with respect to the target 52. The rods 76 extend through the washers 84, springs 82 and the body members 70. The nuts 86 are then threadably secured to the threaded portions 80 of the rods 76. It is preferred that the enlarged head portions 78 have a Phillips screw indentation formed therein so that a Phillips screw driver may be inserted thereinto to prevent rotation of the rods 76 as the nuts 86 are tightened or loosened.

Although it is preferred that the training targets 52 are mounted in the training target openings 48 by the mounts 68, the training targets 52 could be mounted in the openings 48 by rubber or foam.

Figure 6B:
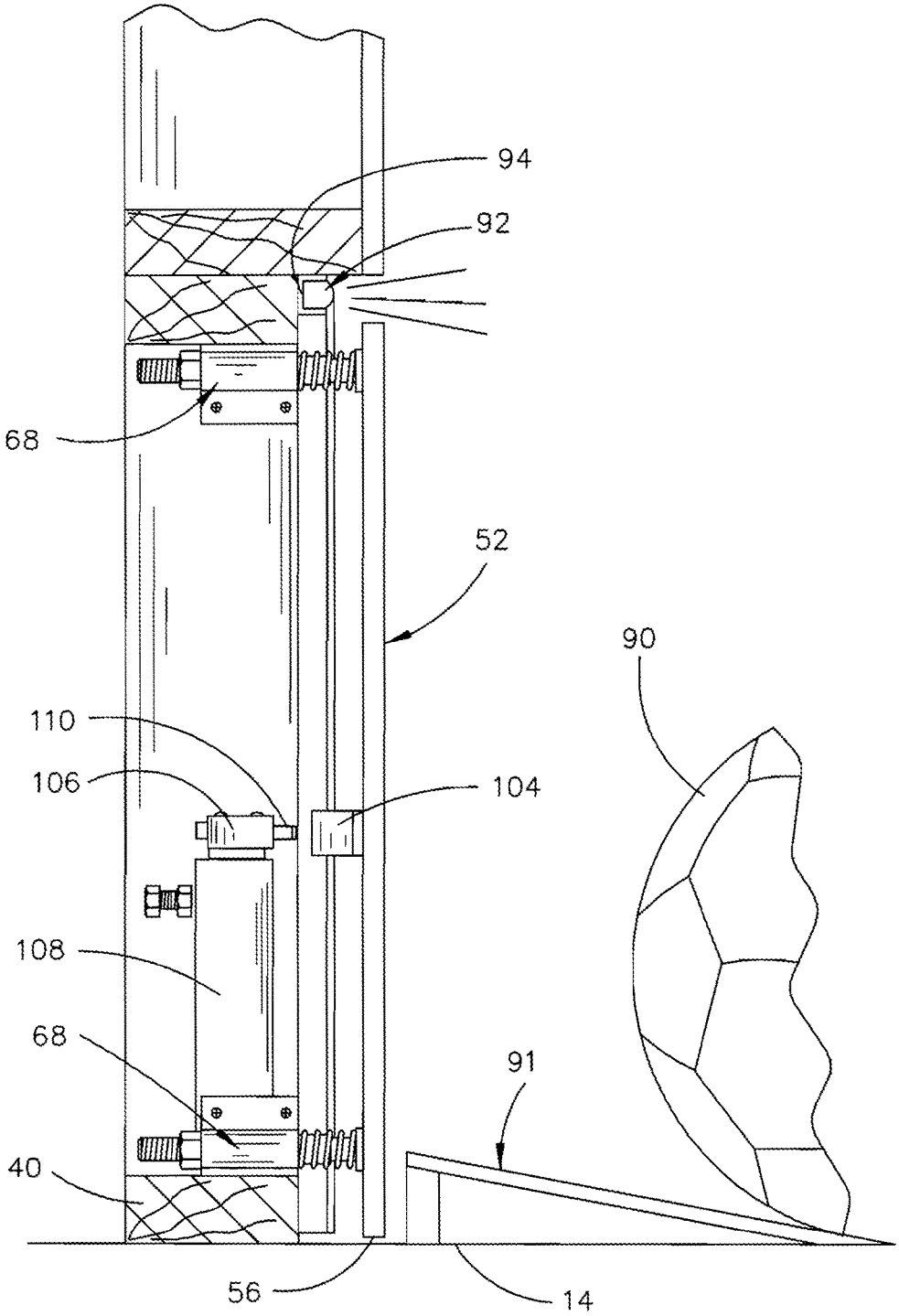
FIG. 6B is a partial sectional view similar to FIG. 6 except that a ramp is positioned on the floor of the facility or arena inwardly of the training target.
Figure 7A:
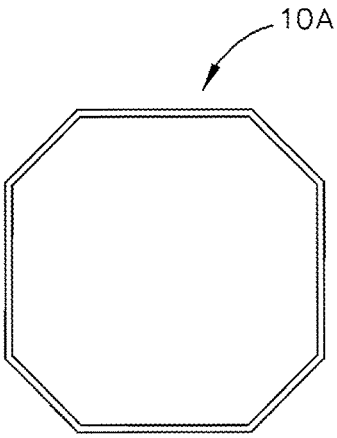
FIGS. 7A-7G are top views of other possible wall configurations of the training facility or arena of this invention.
Figure 7B:
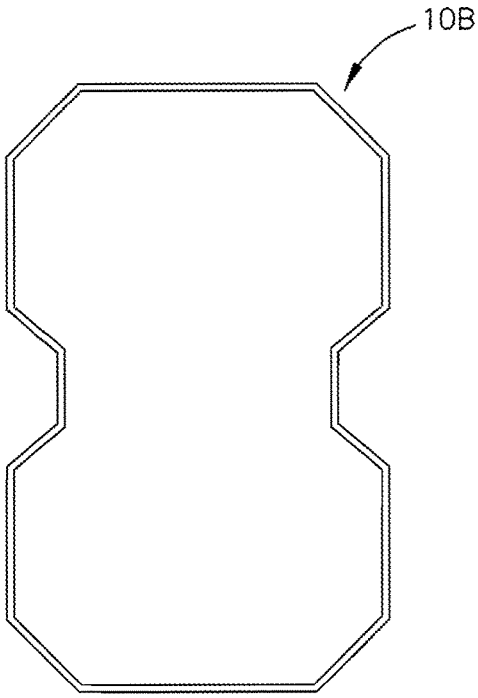
Figure 7C:
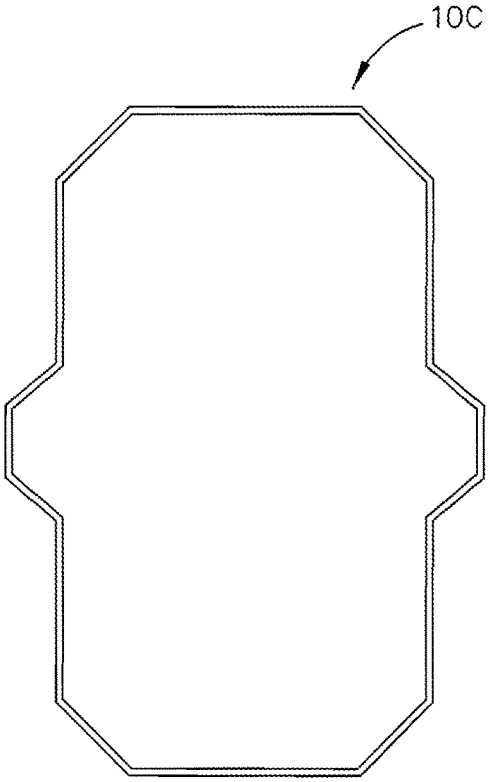
Figure 7D:
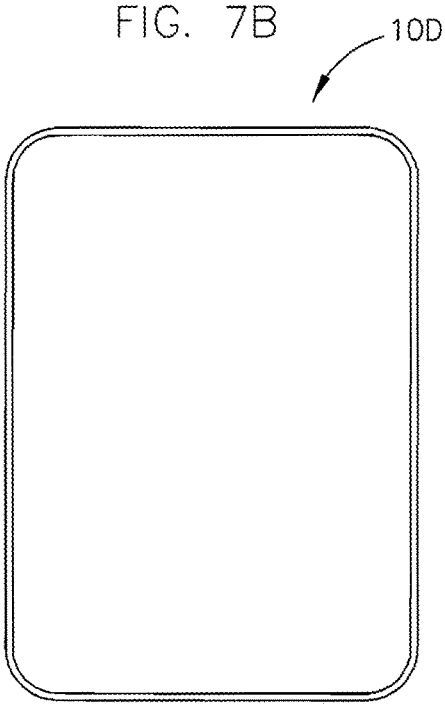
Figure 7E:
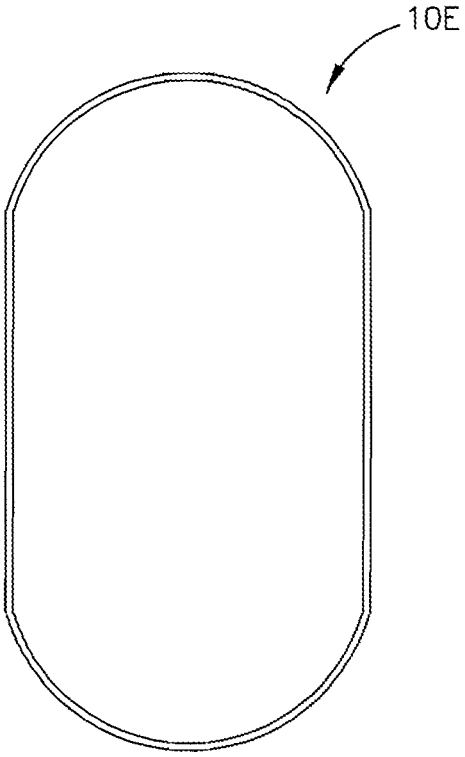
Figure 7F:
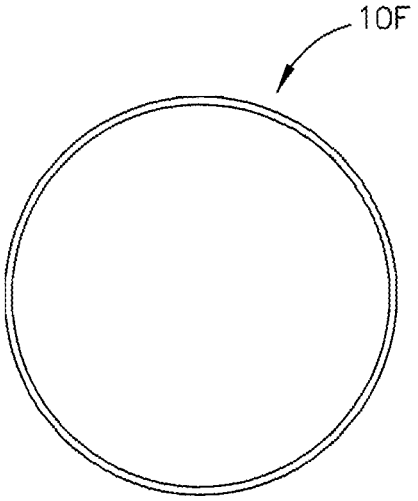
Figure 7G:
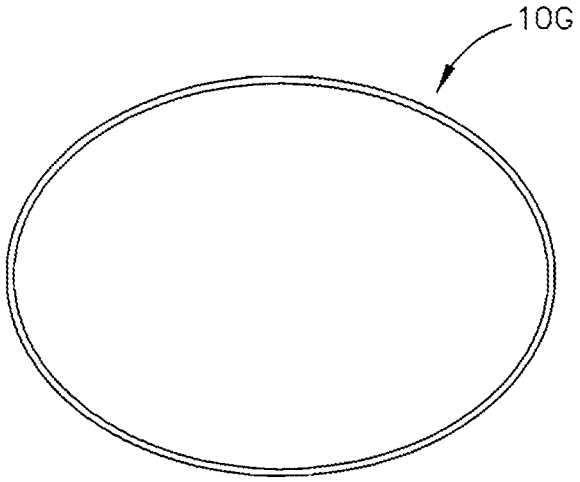

It is also preferred that at least one of the targets 52 have an inclined ramp 91 positioned on the floor 14 inwardly of the lower end 56 of the target 52 as seen in FIG. 6B. The kicked soccer ball 90 moves upwardly on the ramp 91 and strikes the target 52 in such a manner that the soccer ball 90 will be rebounded upwardly and away from the target 52.

The numeral 92 refers to a target illumination means. Target illumination means 92 includes a support frame 94 which includes an upper frame member 96 and side frame members 98 and 100 extending downwardly from the ends of frame member 66. Support frame 94 has its upper frame member 96 secured to frame member 51 and has its side frame members 98 and 100 secured to member 50 by screws or the like.

A light bar 102 is secured to support frame 94 by any convenient means. Light bar 102 extends around the upper end 54 of target 52 and the sides 58 and 60 of target 52.

Each of the targets 52 have a horizontally disposed and rigid strap 104 secured to the outer side thereof. An impact sensor 106 is mounted on the upper end of a support 108 which has its lower end secured to plate 40 as seen in FIG. 2. Sensor 106 includes a switch arm 110 which is closed when a ball 90 strikes the target to move the target 52 outwardly.

Figure 8:
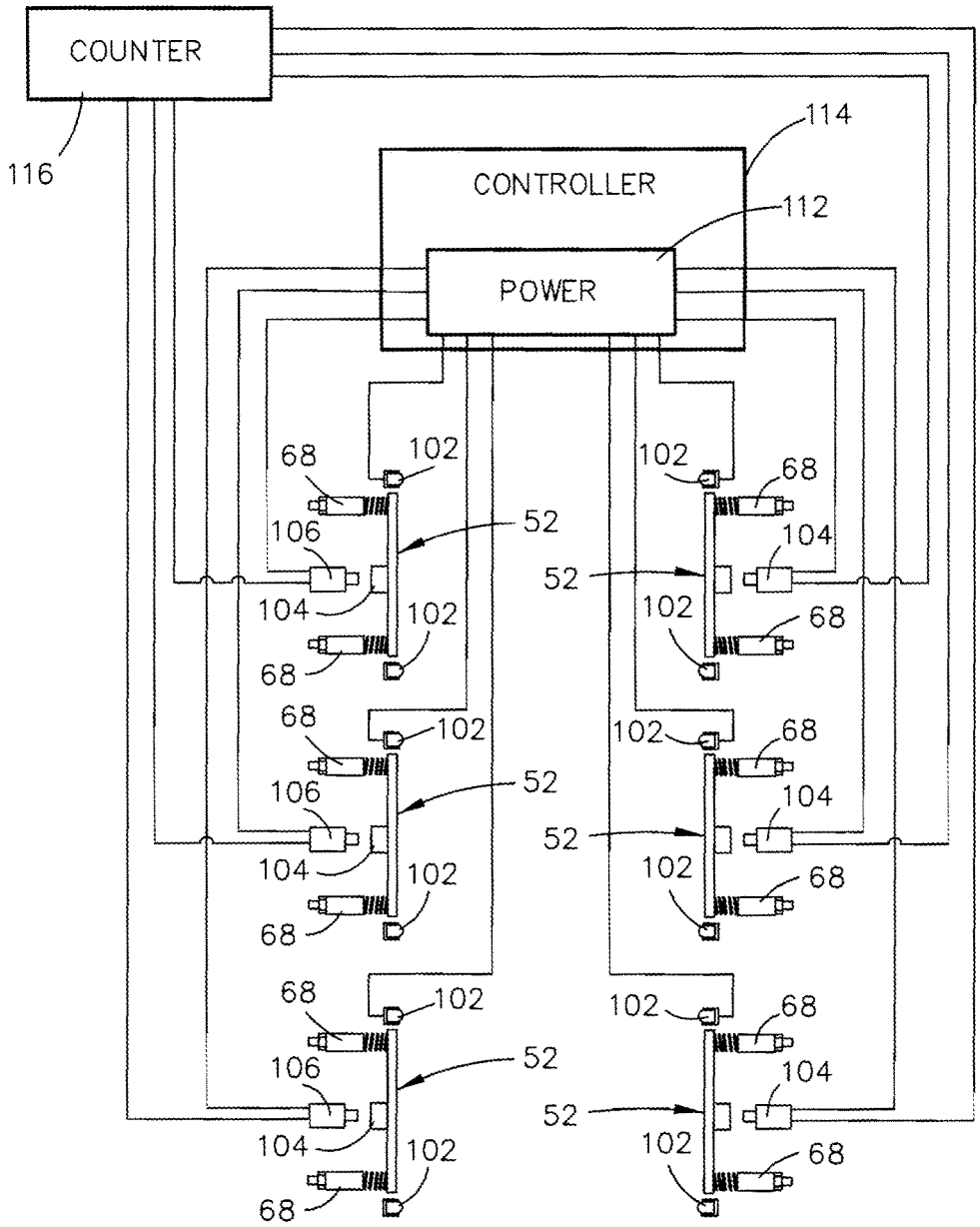
FIG. 8 is a schematic of the control circuits of this invention.

As seen in FIG. 8, the light bars 102 are electrically connected to a source of electrical power 112 and a controller 114. The impact sensors 106 are also electrically connected to the power source 112 and the controller 114 as well as a counter 116.

In operation, the controller sequentially activates the light bar 102 on a particular target 52 for a predetermined length of time. The soccer player who is positioned in the facility must then kick the soccer ball 90 towards the illuminated target 52 within the prescribed period of time. If the kicked soccer ball strikes the illuminated target 52 before the light bar 102 has been deactivated, the target 52 will move outwardly so that the associated sensor 106 will relay the hit to the counter 116. The controller, whether the first target 52 has been struck or not, will then illuminate another target 52. This procedure is repeated for the allotted practice time.

The selective illumination of the targets 52 by the controller 114 causes the soccer player to maneuver to attack another target. The fact that some of the kicked soccer balls are rebounded upwardly and away from the target 52 requires the player to field the ball and place it in position to be kicked to the next target.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

We claim:

1. A soccer training facility for use by a soccer player, comprising:

an upstanding wall extending substantially around a training space positioned on a support surface;

said wall having an upper end, a lower end, an inner side and an outer side;

said wall further including:

(a) an elongated, horizontally disposed base plate positioned at said lower end of said wall and supported on the support surface; and (b) an elongated, horizontally disposed top plate positioned at said upper end of said wall;

a plurality of horizontally spaced-apart recessed openings formed in said lower end of said wall;

each of said plurality of recessed openings having a generally rectangular-shape and having a lower end, an upper end, a first end and a second end; and further including a pair of vertically disposed studs, each having a lower end and an upper end, and a pair of elongated, horizontal upper and lower support members, each respectively disposed between said lower and upper ends of said pair of vertically disposed studs;

wherein said lower end of each said pair of studs including:

a plurality of spring mounts;

a plurality of connector elements, each having an inner end and an outer end, movably positioned within a corresponding spring mount of the plurality of spring mounts with said outer end connected to the respective spring mount, the plurality of connector elements movable between an inner position and an outer position with respect to a respective spring mount;

a plurality of springs associated with said plurality of spring mounts and plurality of connector elements, each spring of the plurality of springs, yieldably urging the respective connector element to said inner position;

a pivotable, generally rectangular-shaped training target positioned in each of said plurality of recessed openings;

each of said plurality of training targets having an inner side, an outer side, a lower end, an upper end, a first end and a second end;

said inner end of each of the connector elements being secured to said first and second ends and upper and lower ends of each of said plurality of training targets;

wherein each of said plurality of training targets is movable with respect to each respective recessed opening between an outer position and an inner position;

wherein each spring of the respective plurality of springs, yieldably maintains the respective training target in said inner position;

each of said plurality of training targets being moved from said respective inner position to said respective outer position upon said respective inner sides thereof being struck by a soccer ball;

each of said plurality of target openings further including a light assembly associated therewith; each of said light assemblies including:

(a) a support frame secured within said recessed opening formed within said wall;

(b) an illumination means having an upper light member, a first side light member and a second side light member, wherein said illumination means is secured to said support frame and extends around a perimeter of each of said plurality of training targets; and wherein said light assemblies illuminating said plurality of training targets when activated.

2. The structure of claim 1 further including a control which selectively activates the light assembly associated with the respective training target to indicate to a player which training target should be addressed and a recorder which records the number of training targets struck by a soccer ball in a predetermined length of time.

3. The structure of claim 1 further including an inclined ramp positioned on said support surface, said ramp positioned inwardly of the lower end of one or more of the plurality of training targets, said ramp directing a soccer ball striking said inclined ramp upwardly towards the respective training target.

4. The structure of claim 1 wherein the recording of a struck training target by a soccer ball occurs when the training target is illuminated.

5. The structure of claim 1 wherein the training targets stays illuminated for a predetermined length of time.

6. The structure of claim 1 wherein at least one of said training targets is inclined so as to extend upwardly and outwardly from said lower end thereof whereby a soccer ball striking the training target rebounds upwardly from the training target towards a player.

7. The structure of claim 1 wherein an impact detector is positioned outwardly of each of said plurality of training targets which is activated when the respective training target is moved from said inner position to said outer position.

* * * * *